US008181899B2

(12) United States Patent
Marietta-Tondin et al.

(10) Patent No.: US 8,181,899 B2
(45) Date of Patent: May 22, 2012

(54) DISPENSER FOR DISPENSING A WOUND SHEET OF PAPER BASED ON TISSUE PAPER

(75) Inventors: Julien Marietta-Tondin, Marckolsheim (FR); Sebastien Jeannot, Holtzwihr (FR)

(73) Assignee: Georgia-Pacific France (FR)

( * ) Notice: Subject to any disclaimer, the term of this patent is extended or adjusted under 35 U.S.C. 154(b) by 352 days.

(21) Appl. No.: 12/513,468

(22) PCT Filed: Oct. 24, 2007

(86) PCT No.: PCT/FR2007/001751

§ 371 (c)(1),
(2), (4) Date: May 4, 2009

(87) PCT Pub. No.: WO2008/065262

PCT Pub. Date: Jun. 5, 2008

(65) Prior Publication Data

US 2010/0025518 A1 Feb. 4, 2010

(30) Foreign Application Priority Data

Nov. 7, 2006 (FR) ..... 06 09711

(51) Int. Cl.
*B65H 16/00* (2006.01)

(52) U.S. Cl. ..... 242/588.3

(58) Field of Classification Search ..... 242/595, 242/596.8, 597.8, 598.5, 588, 588.3, 588.6, 242/596, 597, 598, 397, 397.1, 398, 615.3; 221/33, 36, 41, 42, 44–46; 206/409, 411
See application file for complete search history.

(56) References Cited

U.S. PATENT DOCUMENTS 1,540,876 A * 6/1925 Dwyer ..... 242/595
2,580,982 A 1/1952 Weiss
(Continued)

FOREIGN PATENT DOCUMENTS

| | | |
|---|---|---|
| BE | 905 539 | 2/1987 |
| FR | 2902989 A1 | 1/2008 |
| WO | 97/47444 | 12/1997 |

OTHER PUBLICATIONS

International Search Report for International Application No. PCT/FR2007/001751 dated Apr. 21, 2008.
Written Opinion for International Application No. PCT/FR2007/001751 dated Apr. 21, 2008.

*Primary Examiner* — Michael Mansen
*Assistant Examiner* — Juan Campos, Jr.
(74) *Attorney, Agent, or Firm* — Deborah K. Butler

(57) ABSTRACT

A dispenser, for dispensing a wound dry sheet of paper (F) made of tissue paper, comprising: a cylindrical body; support elements, lying approximately in the same plane P, for resting the dispenser on a horizontal plane; a slot in the cylindrical body for the sheet of paper (F) to exit; a guiding element for guiding the sheet of paper (F) outside the cylinder, associated with said slot, comprising two mutually parallel planes. According to the invention, the two planes are curved, in that the distance E between them is greater than twice the thickness $E_p$ of the sheet of paper (F) and in that the length L of the guiding element, measured along the direction of pay-out of the paper, is equal to or greater than twice a minimum length $L_m$.

8 Claims, 3 Drawing Sheets

U.S. PATENT DOCUMENTS 2,978,156 A 4/1961 Yaniello
3,592,161 A * 7/1971 Hoffmann ..... 118/122
3,995,582 A * 12/1976 Douglas ..... 118/43
4,239,164 A * 12/1980 Barnsbee et al. ..... 242/419.4
4,889,292 A * 12/1989 Loewe et al. ..... 242/588.5
5,439,521 A * 8/1995 Rao ..... 118/415
5,566,873 A * 10/1996 Guido ..... 225/106
6,328,252 B1 * 12/2001 Neveu et al. ..... 242/593

* cited by examiner

DISPENSER FOR DISPENSING A WOUND SHEET OF PAPER BASED ON TISSUE PAPER

CROSS REFERENCE TO RELATED APPLICATIONS

This application claims the benefit of French Patent Application No. 06 09711 filed Nov. 7, 2006 and PCT/FR2007/001751, filed on Oct. 24, 2007, and all the benefits accruing therefrom under 35 U.S.C. §119, the contents of which in their entirety are herein incorporated by reference.

BACKGROUND OF THE INVENTION

The present invention relates to the field of dispensers for wound products, and more particularly for dispensing paper based on tissue paper, such as bathroom tissue or wiping paper, paper towels, etc. Preferably, the rolls are dry.

In general, this type of dispenser comprises a cylindrical body provided with a slot for an opening for the paper to exit. The slot or opening lies in the lower part of the cylindrical body in a position of use such that the paper easily exits the dispenser, but sometimes too easily.

U.S. Pat. No. 2,978,156 discloses a dispenser of this type, which is intended to be attached to a wall and has an opening placed in the lower part of the cylindrical body surrounding the roll. According to this prior art, the opening is extended by a paper-guiding element in the form of straight and mutually parallel lips.

Also known, from document WO 97/47444, is a package forming a dispenser for wound paper sheets. The package consists of a plastic shell (in fact two half-shells) surrounding the roll, and is provided with a guiding element consisting of straight lips that extend the paper exit slot. This device is portable and the guiding element is diametrically opposite the hinge constituting the link between the two plastic half-shells.

Of course, this device cannot be efficiently used if it is laid down, as it has no intrinsic stability. In other words, it can be used only if it is held between one's two hands.

The present invention relates more particularly to wound paper dispensers intended to be laid on a horizontal plane, and making it possible to extract paper from the top of the dispenser using a single hand.

The dispensed paper at the top of a dispenser, and using a single hand, is known, as regards sheets of paper of the interfolded type, that is to say sheets that are cut, folded and then made to overlap one another.

U.S. Pat. No. 2,580,982 discloses a dispenser of this type, which is of parallelepipedal shape and has a paper exit slot on its upper main face. Characteristically, the exit slot is of wavy shape and may be surmounted by a guiding element, for example in the form of a figurine, such as a fish or other decorative element.

Although the above patent shows that dispensing is easy, in the upper part of a laid-down device, it is neither known nor easily conceivable to produce a dispenser of this type for wound products, and more specifically for sheets of tissue paper.

According to one embodiment disclosed in French Patent Application EN 06/52766 filed in the name of the Applicant, such dispensing may be envisaged.

However, when used laid down and not attached, it turns out that the paper very often drops inside the dispenser. This is probably due to the virtual absence of friction at the slot or the guiding element. What happens is that, in the case of a round product, once the end sheet has been extracted and cut, the next sheet is retained inside the dispenser as it is linked to the roll which, being located beneath the opening, "weighs" on the sheet and takes it towards the inside of the dispenser.

To alleviate such a problem, it is conceivable to reduce the spacing between the lips forming the guide for the sheet exiting the dispenser.

However, this solution has limits since the paper, and especially the tissue paper, tears easily. This has been observed in tests. An insufficient spacing, of the order of the thickness of the paper sheet to be unwound, leads to the sheet being jammed or even torn.

Moreover, it has already been proposed in U.S. Pat. No. 3,592,161, a paper roll dispenser being necessarily laid on a horizontal plane, and formed from two parts, namely a lower semicylindrical part serving as liquid reservoir, on which a semicylindrical cover of complementary shape is placed. The roll contained inside is immersed in the liquid and can be unwound, to the outside of the dispenser, through a dispensing element formed by two slightly curved lips, one belonging to the lower part of the dispenser and the second to the cover laid on the lower part.

In this case, partial contact is provided between the two lips so as to press the moist or even wet paper and make the excess liquid fall into the semicylindrical reservoir.

Such an arrangement, although suitable for wet sheets, cannot be transposed to dry sheets for the reason mentioned above, namely the fact that dry sheets, especially sheets of tissue paper, tear and/or become jammed between the two lips placed in this way.

SUMMARY OF THE INVENTION

The present invention proposes a novel and unexpected solution to the aforementioned problem, which is both simple and reliable.

Thus, the subject of the present invention is a dispenser, for dispensing a wound dry sheet of paper made of tissue paper, comprising:

- a cylindrical body;
- support elements, lying approximately in the same plane P, for resting the dispenser on a horizontal plane;
- a slot in the cylindrical body for the sheet of paper to exit, said slot lying along a generatrix of the cylindrical body, in a region substantially diametrically opposed to the plane P containing the support elements;
- a guiding element for guiding the sheet of paper outside the cylinder, associated with said slot, comprising two mutually parallel planes.

According to the invention, the two planes are curved, the distance E between the two curved planes is greater than twice the thickness $E_p$ of the sheet of paper and the length L of the guiding element, measured along the direction of unwinding the paper, is equal to or greater than twice a minimum length $L_m$ such that:

$$L_m = 2 \times \pi \times R \times A/360,$$

where $$A = 2 \times \arccos((R - E + E_p/2)/(R - E_p/2)),$$

and where

R=radius of the osculating cylinder of the outer curved plane;

E=distance between the facing surfaces of the two planes;

Preferably, the distance E is between 2.5 and 3.5 times the thickness of said sheet (F) and in that the length L of the guiding element is greater than 2.5 times said minimum length $L_m$.

According to another feature of the invention, the angle A is equal to or less than 95°.

As an illustration, said sheet of paper is a sheet of tissue paper, the thickness of which is between 0.2 and 1.2 mm.

According to one embodiment of the invention, the cylindrical body is formed from two half-shells each comprising one of the curved planes forming the guiding element.

More precisely, the two half-shells are joined along one of their generatrices by an element forming a hinge.

Advantageously, the linking region inside the dispenser, between the slot and each of the curved planes, does not have a sharp edge.

Preferably, at least one of the free ends of each of the curved planes has sharp edges, such as sawteeth.

Other features, details and advantages of the invention will emerge from the following description, given by way of illustration but implying no limitation, and with reference to the appended drawings in which:

DETAILED DESCRIPTION OF THE INVENTION

Figure 1:
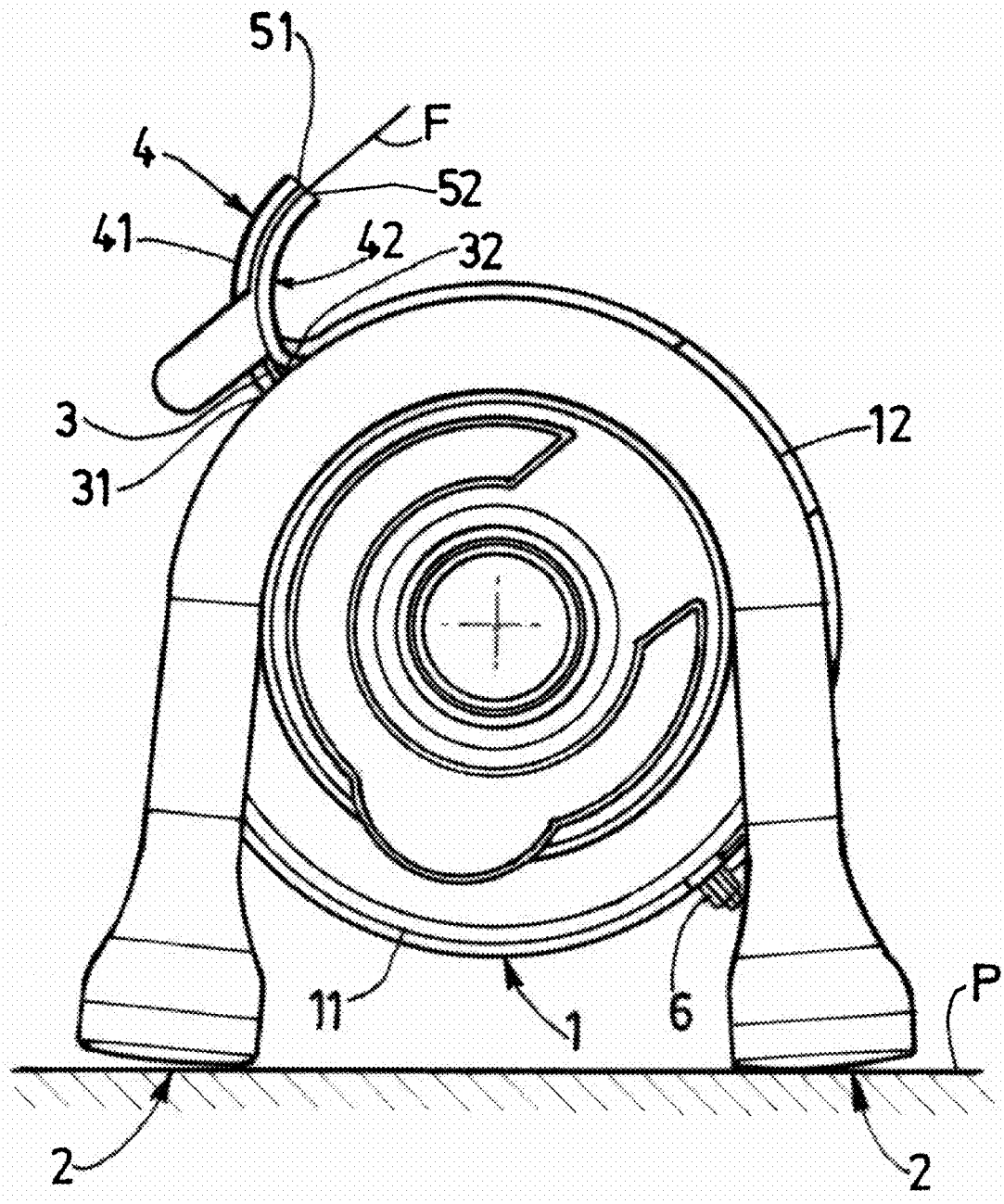
FIG. 1 is a side view of a dispenser according to the invention.
Figure 2:
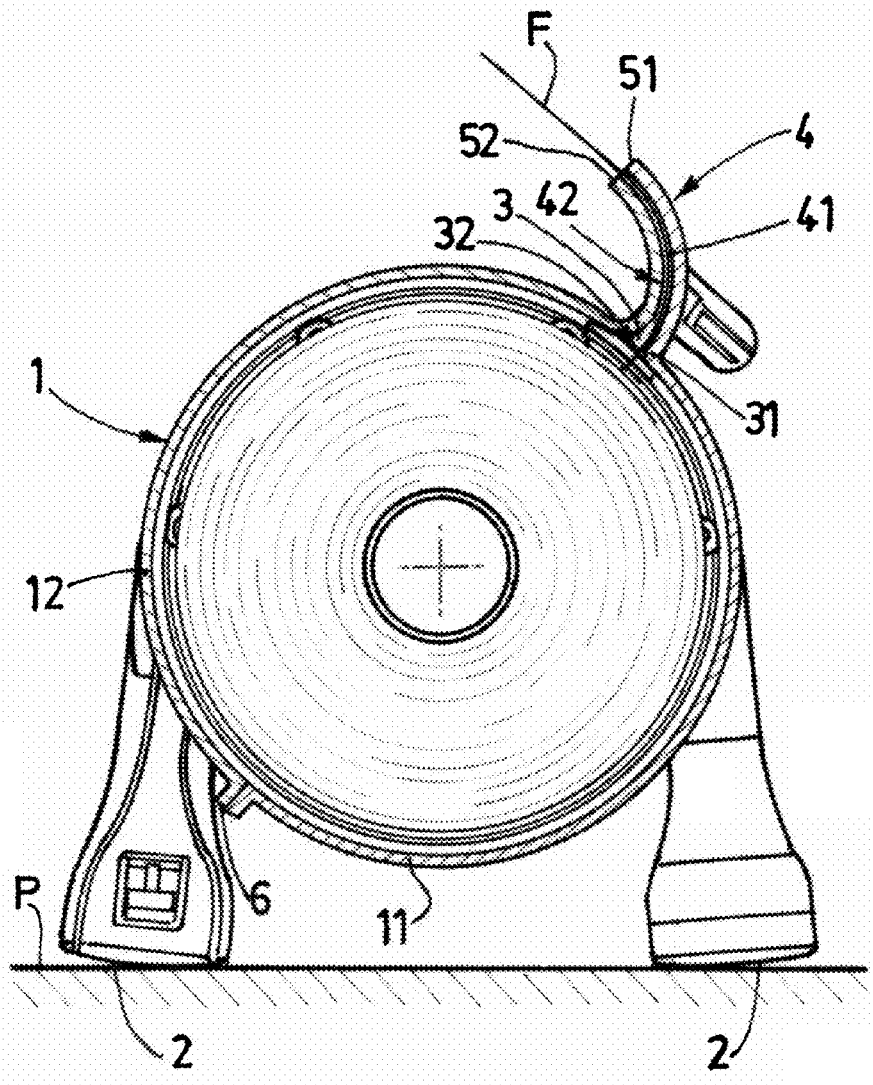
FIG. 2 is a cross section of a dispenser according to the invention.

FIGS. 1 and 2 show, by a side view and a cross section respectively, a dispenser according to one embodiment of the invention, which comprises, in a known manner, a cylindrical body 1 and support elements 2, such as feet lying substantially in the same plane P.

A slot 3 is provided in the upper part of the dispenser, which is placed on a horizontal plane, as the exit for the sheet of paper F forming the roll. The slot 3 lies along a generatrix of the cylindrical body 1, which itself may be formed from two semicylinders 11, 12. A rotary link, such as a hinge 6, may be provided between the semicylinders 11, 12 on another generatrix of the cylindrical body 1, preferably diametrically opposite the slot 3.

When the dispenser is in its use position, it is therefore in contact via its support elements 2 with a horizontal plane coincident with the plane P, and the slot 3 is located in the upper part of the dispenser.

A guiding element 4, associated with the slot 3, is provided for guiding the sheet of paper F. This element comprises two mutually parallel planes 41, 42.

In accordance with the invention the planes 41, 42 are curved in such a way that a point of inflexion exists between part of the cylindrical body 1 here the upper semicylinder 12, and said planes.

The curved plane 41 is called the outer curved plane, while the curved plane 42 is the inner curved plane.

The planes 41, 42 are spaced apart by a distance E greater than twice the thickness $E_p$ of the sheet of paper, preferably between 2.5 times and 3.5 times the thickness $E_p$ of said sheet F.

This feature contributes in particular to preventing the sheet F from jamming and tearing inside the guiding element 4.

To further improve unwinding while in particular avoiding the risk of the sheet F dropping inside the body 1, a specific dimension of the guiding element 4 is recommended; more precisely, the minimum length $L_m$, in order that, during unwinding the roll, there is friction between the sheet and the two curved planes 41, 42 forming the element 4 measured along the direction in which the sheet of paper F is unwound, satisfies the following equation:

$$L_m=2\times\pi\times R\times A/360 \quad (1)$$

where $$A=2\times\text{arc cos}((R-E+(E_p/2))/(R-(E_p/2)) \quad (2)$$

and where

R=radius of the osculating cylinder of the outer curved plane;

E=distance between the facing surfaces of the two planes 41, 42; and $E_p$=thickness of the sheet of paper.

Figure 3:
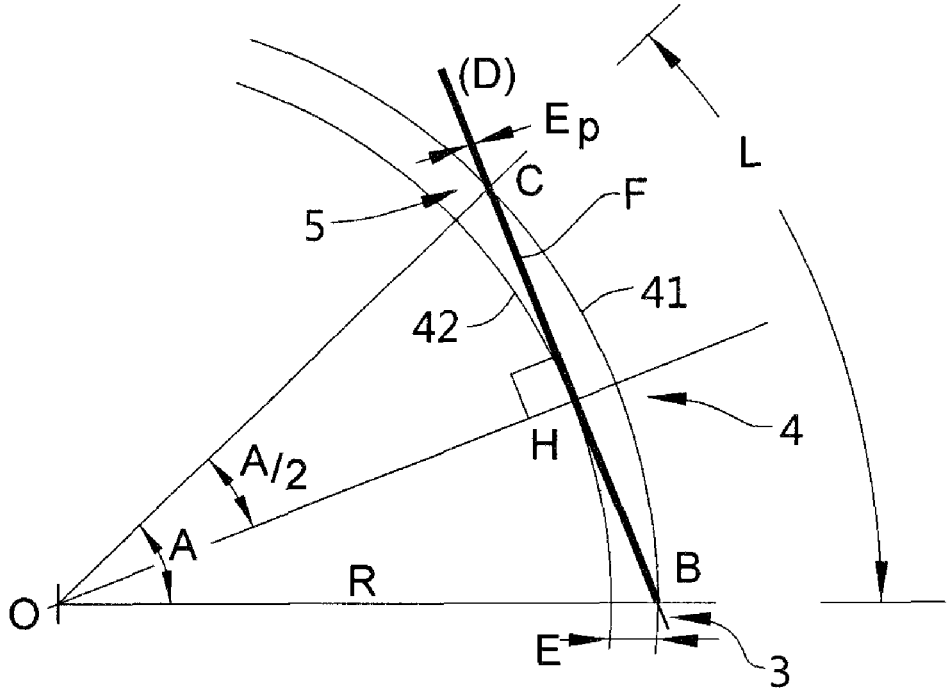
FIG. 3 is a diagram explaining the equation relating to the dimensions of the claims forming the paper-guiding element.

FIG. 3 is a diagram explaining how the aforementioned equations (1) and (2) were developed.

Equation (1) basically defines the minimum length of the curvature so that there is friction between the sheet and the slot 3 until the paper exits at 5.

The two curved planes 41 and 42 can be likened to the two portions of the osculating circles of these curves, which are concentric, of centre O and radius R in the case of the plane 41 and radius (R−E) in the case of the plane 42.

A straight line (D) tangential to the circle of radius (R−E) is drawn. This tangent cuts the circle of radius R at the points B and C. The angle A at the apex O defined between the segments OB and OC is thus defined.

The bisector of the angle A, which is also the right bisector, cuts the circle of radius R−E at H. Two right-angled triangles OHC and OHB, with an apex angle of A/2 are thus formed, in which the following equations apply:

$$\cos(A/2)=OH/OC$$

$$\cos(A/2)=(R-E)/R$$

hence $$A/2=\text{arc cos}((R-E)/R)$$

and hence $$A=2\times\text{arc cos}((R-E/R)).$$

In fact, the sheet F cannot be completely likened to the straight line D as it possesses a thickness $E_p$. A slight correction has led to the addition of a half-thickness to the numerator and to the subtraction of a half-width in the denominator, hence the corrected formula:

$$A=2\times\text{arc cos}((R-E+E_p/2)/(R-E_p/2)).$$

Thus, an angle A representing the minimum angle for there to be friction of the sheet F between the planes 41 and 42 is determined. The angle A is expressed in degrees.

The corresponding arc length is therefore:

$$L_m=2\times\pi R\times A/360.$$

Advantageously, the curved planes 41, 42 present, as a minimum, a length in the unwinding direction of the sheet F equal to twice the value $L_m$.

Preferably, the length L will be chosen to be more than 2.5 or even 3.5 times the length $L_m$ and the associated angle A is equal to or less than 95°. Specifically, the most satisfactory results have been obtained with values of this type.

Example 1

R=20 mm
E=1.1 mm
$E_p$=0.32 mm $$A=2\times\arccos((R-E+E_p/2)/(R-E_p/2)).$$

⇒hence A=32°
and hence $$L_m=2\times\pi\times20\times32/360$$

=11.3 mm.

In this trial we have L=15.7 mm>$L_m$, but L is not greater than 2.5 times $L_m$.

Here, the angle A is equal to 32°, and therefore less than 95°.

This trial did not give satisfactory results since the level of failures, that is to say non-fluid unwinding, was 13%. This result is considered to be too high.

The expression "non-fluid unwinding" should be understood to mean unwinding including incidents, such as the sheet jamming between the two planes either by crumpling, by being folded on itself, or by tearing or cutting inadvertently in this dispensing area, or else in the unwinding mechanism before the sheet passes between the curved planes 41, 42.

Of course, each incident entails opening the dispenser in order to reposition the sheet correctly. This is irksome for the user.

Example 2

R=20 mm
E=1.1 mm
$E_p$=0.32 mm $$\Rightarrow=A=2\times\arccos((20-1.1+0.16)/(20-0.16))=$$

=32°
⇒=11.3 mm

The level of failure in unwinding here is 6%, which is deemed to be satisfactory.

The calculated values of A and $L_m$ corroborate these results since A<95° and $L_m$=11.3 mm<2.5 times L, where L in this example is equal to 31.4 mm.

As already mentioned, the paper sheets may have a "slight" thickness, of around 0.30 mm for bathroom paper applications. Sheets of tissue paper of the towel paper type are also intended by the invention, these having thicknesses of greater than 1 mm.

Moreover, as may be seen in particular in FIG. 2, the cylindrical body 1 is formed from two half-shells 11 and 12 joined together, for example by a hinge 6 along one of their generatrices, diametrically opposite the paper exit slot 3.

At said slot 3, the connection region with the curved planes 41, 42 is rounded, with no sharp edge, so as to make it easier for the paper to be guided and slid in this region.

In contrast, the ends 51, 52 of the curved planes 41, 42 at the paper exit preferably have sharp edges so as to make it easier to cut the paper. If the sheet of paper is pre-cut, a single straight sharp edge may be provided, whereas if the sheet has no line of weakness, one of the ends 51 or 52 of the curved planes 41, 42 may be provided with sawteeth and so making it easier to cut the paper.

Finally, it has been found, advantageously, that the radius of curvature of the curved planes 41, 42 may vary from 5 mm to 50 mm without departing from the scope of the invention.

The invention claimed is:

1. A dispenser for dispensing a wound dry sheet of paper made of tissue paper, comprising:

a cylindrical body;

support elements, lying approximately in the same plane, disposed and configured for resting the dispenser on a horizontal plane;

a slot in the cylindrical body disposed and configured for the sheet of paper to exit, said slot lying along the cylindrical body, in a region substantially diametrically opposed to the plane containing the support elements;

a guiding element disposed and configured for guiding the sheet of paper outside the cylindrical body, associated with said slot, comprising two mutually parallel surfaces, wherein the two surfaces are curved, in that a defined distance E between the two curved surfaces is greater than twice a defined thickness $E_p$ of the sheet of paper and in that a defined length L of the guiding element, measured along the direction of unwinding the paper, is equal to or greater than twice a minimum length $L_m$ of the guiding element, wherein:

$$L_m=2\times\pi\times R\times A/360,$$

where A=2×arc cos((R−E+$E_p$/2)/(R−$E_p$/2)), and where R=radius of curvature defining the outer curved surface;

E=distance between facing faces of the two surfaces;

$E_p$=thickness of the paper sheet.

2. The dispenser according to claim 1, wherein the distance E is between 2.5 and 3.5 times the thickness of said sheet ($E_p$) and in that the length L of the guiding element is greater than 2.5 times said minimum length $L_m$.

3. The dispenser according to claim 1, wherein the angle A is equal to or less than 95°.

4. The dispenser according to claim 1, wherein said sheet of paper is a sheet of tissue paper, the thickness ($E_p$) of which is between 0.2 and 1.2 mm.

5. The dispenser according to claim 1, wherein the cylindrical body is formed from two half-shells each comprising one of the curved surfaces forming the guiding element.

6. The dispenser according to claim 5, wherein each of the two half shells are joined by an element forming a hinge.

7. The dispenser according to claim 1, wherein each of the curved surfaces includes a corresponding free end, at least one of the free ends has sharp edges.

8. The dispenser according to claim 1, wherein the minimum radius R of the radius of curvature of the curved surface is around 5 mm.

* * * * *